US006402583B2

(12) United States Patent
Yoneda et al.

(10) Patent No.: US 6,402,583 B2
(45) Date of Patent: Jun. 11, 2002

(54) PARKING AREA TOY

(75) Inventors: Yosuke Yoneda; Katsumi Kakizaki, both of Tokyo (JP)

(73) Assignees: Tomy Company, Ltd.; Imagic, Inc., both of Tokyo (JP)

( * ) Notice: Subject to any disclaimer, the term of this patent is extended or adjusted under 35 U.S.C. 154(b) by 0 days.

(21) Appl. No.: 09/769,520

(22) Filed: Jan. 26, 2001

(30) Foreign Application Priority Data

Feb. 8, 2000 (JP) ..... 2000-30987
Feb. 8, 2000 (JP) ..... 2000-30988

(51) Int. Cl.[7] ..... A63H 17/44
(52) U.S. Cl. ..... 446/423
(58) Field of Search ..... 446/423, 424, 446/476

(56) References Cited

U.S. PATENT DOCUMENTS 1,627,959 A * 5/1927 Disney
3,457,668 A * 7/1969 Genin
3,483,653 A * 12/1969 Genin
3,593,454 A * 7/1971 Einfalt
3,694,953 A * 10/1972 Tomiyama
3,789,538 A * 2/1974 Spengler et al.
5,643,040 A * 7/1997 Hippely et al. ..... 446/423 X

* cited by examiner

*Primary Examiner*—John A. Ricci
(74) *Attorney, Agent, or Firm*—Staas & Halsey LLP

(57) ABSTRACT

A parking area toy comprising: a body (10); a turn table (50) which can be rotated around a vertical axis and can be moved up and down along the vertical axis; a plurality of parking spaces (1–7) for parking a plurality of car toys (20), which are disposed on a plane around a passage for the turn table; a turn table rotating member (M, 20*h*, 80) for rotating the turn table around the vertical axis; a turn table lifting member (M, 10*n*, 12*a*) for moving the turn table up and down along the vertical axis; and a member for driving a car toy in and out (51, 52, 53, 54), which has a placing member (53) for placing a car toy (20) thereon and which is for moving a car toy into or out of a predetermined parking space by operating the placing member.

10 Claims, 12 Drawing Sheets

PARKING AREA TOY

BACKGROUND OF THE INVENTION

1. Field of the Invention

The present invention relates to a parking area toy, in particular, a parking area toy having a plurality of parking spaces, in which a car toy can be come into a desired parking space and a car toy can be come out of a desired parking space.

2. Description of Earlier Development

A conventional parking area toy as described in Japanese Utility Model Application Publication (Examined) No. Jitsuko-sho-49-22314 is known. In the parking area toy, a car toy is transferred to a desired floor of the parking area by ascending a table on which a car toy is placed, and by rotating a rotary body having four parking spaces which are arranged in a cross-shape adjacent to the ascent and descent space of the table to face the table to a desired parking space on the desired floor, and then the car toy is transferred into the desired parking space.

However, the above-described conventional parking area toy is widely different from the real parking area in that the table on which a car toy is placed ascends or descends only and the parking spaces arranged adjacent to the ascent and descent space of the table are rotated.

SUMMARY OF THE INVENTION

The present invention has been made for solving such problems.

An object of the present invention is to provide a parking area toy like a real parking area.

That is, in accordance with an aspect of the invention, the parking area toy comprises: a body; a turn table which can be rotated around a vertical axis and can be come up and down along the vertical axis; a plurality of parking spaces for parking a plurality of car toys, which are disposed on a plane around a passage for the turn table; a turn table rotating member for rotating the turn table around the vertical axis; a turn table lifting member for moving the turn table up and down along the vertical axis; and a member for driving a car toy in and out, which has a placing member for placing a car toy thereon and which is for going a car toy into or out of a predetermined parking space by operating the placing member.

Herein, the "turn table lifting member" may have a wrapping connector driving mechanism. Concretely, the turn table may be moved up and down by engaging the turn table with a string wrapped around a pulley or a chain wrapped around a sprocket and by rotating the pulley or the sprocket.

According to the parking area toy, it is possible to park a car toy into an optional parking space among a plurality of parking spaces which are disposed around the passage for moving the turn table up and down therethrough and to drive the car toy out of an optional parking space onto the turn table.

Preferably, the turn table lifting member comprises a first shaft extending along the vertical axis, which forms a screw pair together with the turn table and is rotationally driven by a motor, and the turn table is moved up and down along a column by rotating the first shaft reciprocally by the motor.

According to the parking area toy, it is possible to move the turn table up and down by providing a first shaft which forms a screw pair together with the turn table, and a column for guiding the turn table to move up and down, in the passage for moving the turn table up and down, and only by rotationally driving the first shaft by using a power source outside the passage for moving the turn table up and down.

The turn table rotating member may have a gear wheel which is provided at a lower position and is rotationally driven around the vertical axis by a motor, and the turn table and the gear wheel may be coupled with each other by a column so as to be rotatable as a body, and the turn table may be rotationally driven by the motor through the gear wheel.

According to the parking area toy having such a structure, it is possible to rotationally drive the turn table through the column by driving the gear wheel rotationally which is provided at a lower position of the body.

The member for driving a car toy in and out comprises a second shaft extending along the vertical axis, which is rotationally driven by a motor, and the car toy is driven in or out by rotating the second shaft by the motor.

According to the parking area toy having such a structure, it is possible to drive the car toy in or out by rotating the second shaft independent of the first shaft.

Preferably, the turn table rotating member, the turn table lifting member and the member for driving a car toy in and out can be driven by only one motor, and the turn table rotating member, the turn table lifting member and the member for driving a car toy in and out are driven selectively.

According to the parking area toy having such a structure, it is possible to drive the car toy in or out of a desired driving place, by operating the turn table rotating member, the turn table lifting member and the member for driving a car toy in and out, by only one motor.

Preferably, the body has a plurality of stories each having a plurality of parking spaces.

According to the parking area toy having such a structure, it is possible to park in a plurality of parking spaces which are provided on each story.

Preferably, the parking area toy further comprises a floor selection member for setting a floor to be parked and a lateral position selection member for setting a parking space to be parked in a floor, wherein the turn table rotating member, the turn table lifting member and the member for driving a car toy in and out goes the car toy in or out of a parking space set by the floor selection member and the lateral position selection member.

According to the parking area toy having such a structure, it is possible to move the toy car in or out of a desired parking space.

Preferably, the floor selection member comprises: a vertically erected rotatable shaft a rotational angle of which is varied according to the set floor, and a plurality of stoppers attached to a periphery of the erected rotatable shaft at an interval, each having a projection extending in a lateral direction different from one another, so that the erected rotatable shaft rotates and stops at a position that the projection of a corresponding stopper can engage with and stop the turn table.

In accordance with another aspect of the invention, the parking area toy comprises: a body comprising a plurality of stories; a turn table which can be rotated around a vertical axis and can be moved up and down along the vertical axis; a plurality of parking spaces for parking a plurality of car toys, which are disposed on each of the stories, around a passage for the turn table; a turn table rotating member for rotating the turn table around the vertical axis; a turn table lifting member for moving the turn table up and down along the vertical axis; and a member for driving a car toy in and out, which has a placing member for placing a car toy thereon and which is for going a car toy into or out of a predetermined parking space by operating the placing member; wherein the turn table rotating member, the turn table lifting member and the member for driving a car toy in and out can be driven by only one motor.

According to the parking area toy, it is possible to park a car toy into an optional parking space among a plurality of parking spaces which are disposed around the passage for moving the turn table up and down therethrough and to drive the car toy out of an optional parking space onto the turn table.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Hereinbelow, an embodiment of the invention will be described with reference to the drawings.

Figure 1:
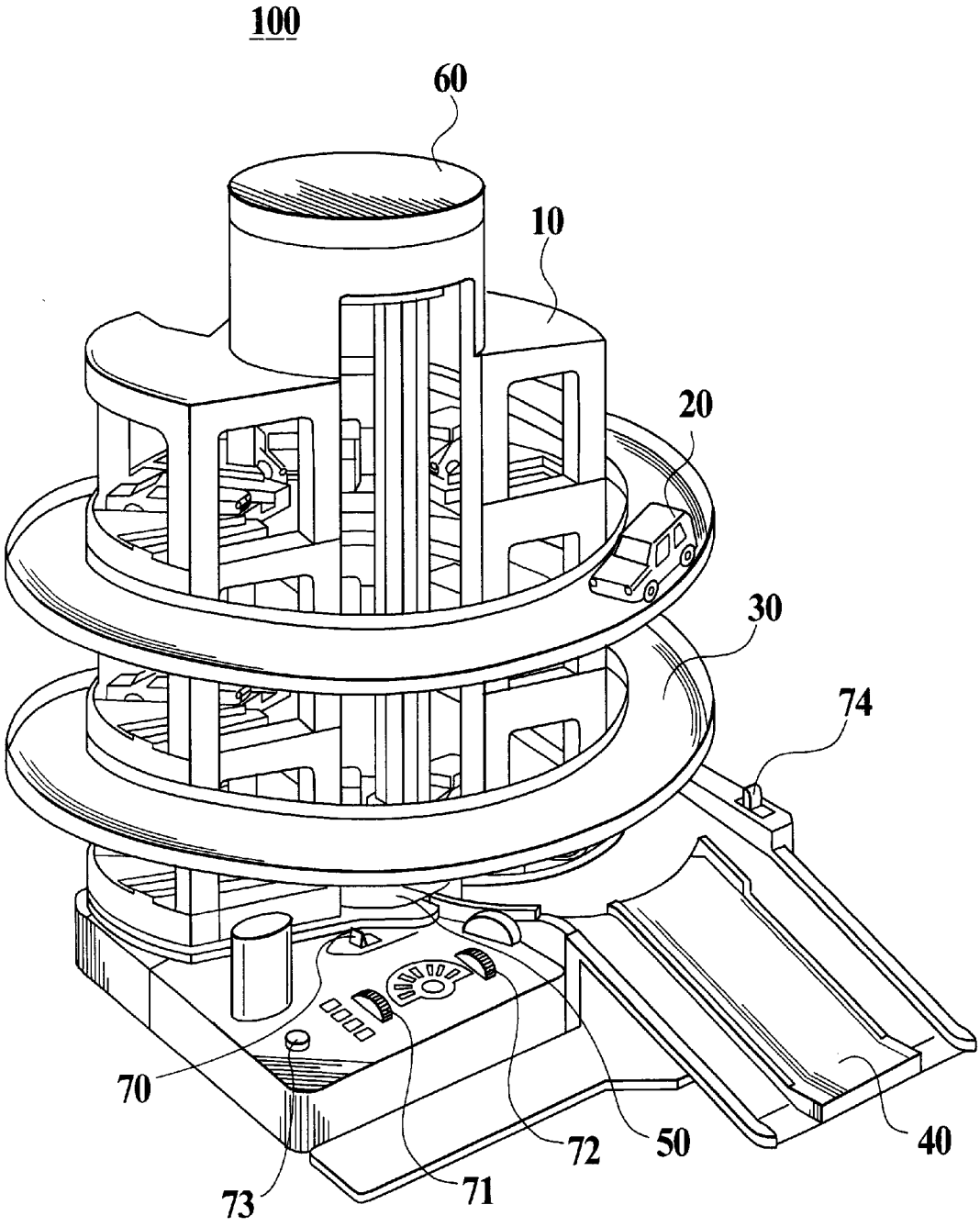
FIG. 1 is a perspective view for showing a parking area toy according to an embodiment of the invention.
Figure 2:
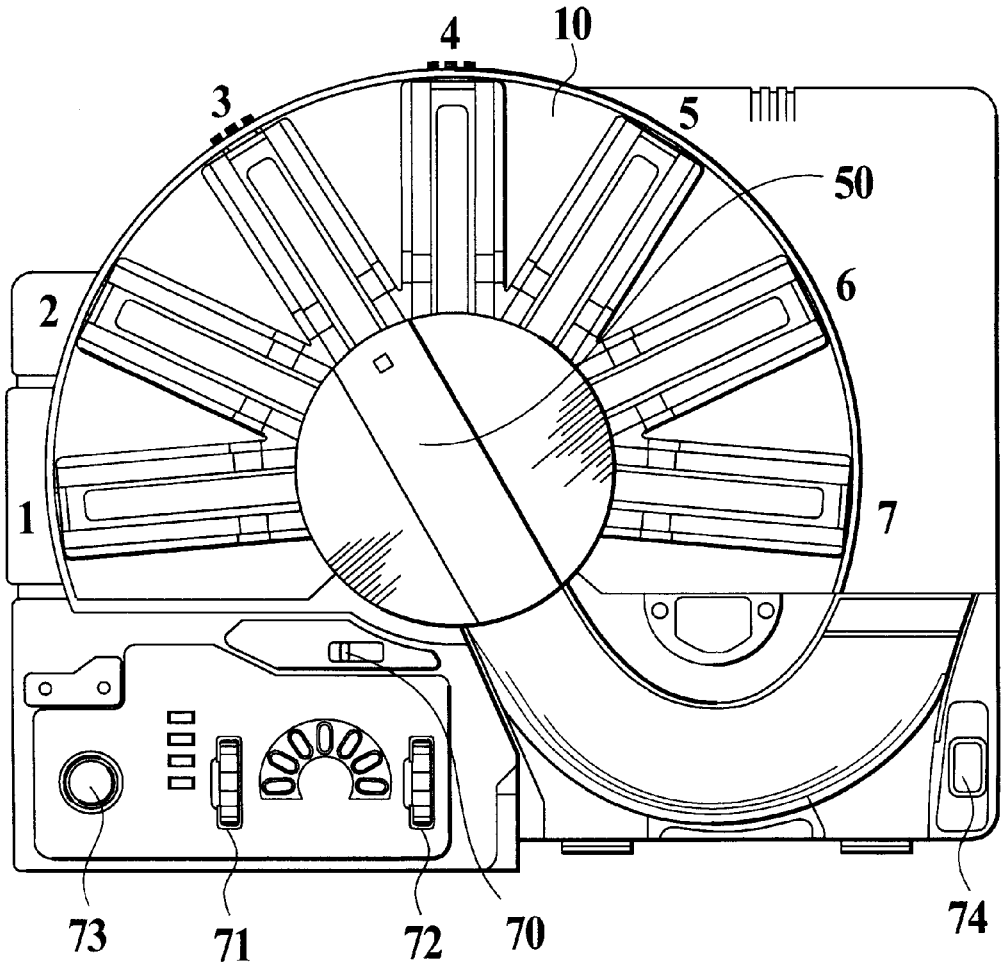
FIG. 2 is a plan view for showing the parking spaces of the parking area toy shown in FIG. 1.

FIG. 1 shows the parking area toy 100 according to an embodiment of the present invention. The body 10 of the parking area toy 100 has three floors each having 7 parking spaces. Every parking space on each floor has an attached number among 1 to 7 in order, as shown in FIG. 2. Around the body 10, a spiral slope 30 is arranged for a car toy 20 to come down. The body 10 is provided with a slope 40 which is used for the car toy 20 to come into or out of the body 10. At approximately the center of the body 10, a turn table 50 is provided for placing the car toy 20 thereon. The body 10 is also provided with a heliport 60 at the rooftop thereof.

The method to use the parking area toy 100 will be explained briefly, as follows.

First, the car toy 20 is placed on the turn table 50 through the slope 40, as shown in FIGS. 1 and 2. In this state, a switch lever 70 is turned on. Before placing the car toy 20 on the turn table 50, the switch lever 70 may be also turned on. Then, the floor to park the car toy 20 is selected by rotating a floor selection dial 71 and the number of a parking space on the floor to park the car toy 20 is selected by rotating a lateral position selection dial 72. The order of the rotational operations of the floor selection dial 71 and the lateral position selection dial 72 may be reversed. Thereafter, when pushing down an operational button 73, the turn table 50 goes up to the floor selected by the floor selection dial 71 and then the turn table 50 rotates so that the turn table 50 faces to the parking space selected, that is, so that the rear portion of the car toy 20 on the turn table 50 faces to the parking space selected, by the lateral position selection dial 72. The car toy 20 on the turn table 50 is then run into the desired parking space with the rear portion taking the lead. Thereafter, the turn table 50 rotates to return to the initial rotational position and moves up to the roof with keeping the state. The moved turn table 50 to the roof carries out an action for discharging a car toy 20, although because the turn table 50 has no car toy 20 thereon in this case, actually, no car toy is discharged. Then, the turn table 50 descends to return to the lowest initial height position.

Next, how to run a parked car toy 20 out of the parking space will be explained, as follows.

First, the parking floor and the parking space where the car toy 20 to be run out is parked are selected by rotating the floor selection dial 71 and the lateral position selection dial 72. In the state, when pushing down the operational button 73, the turn table 50 goes up to the floor selected by the floor selection dial 71 and then the turn table 50 rotates so that the turn table 50 faces to the parking space with the number selected by the lateral position selection dial 72. The car toy 20 is moved from the parking space onto the turn table 50. Thereafter, the turn table 50 rotates to return to the initial rotational position and moves up to the roof with keeping the state. When the moved-up turn table 50 reaches to the roof, the car toy 20 is come out of the turn table 50. Then, the turn table 50 descends to return to the lowest initial height position. On the other hand, the car toy 20 discharged from the turn table 50 goes down through the spiral slope 30, and comes to be placed onto the turn table 50 again or comes to be discharged out of the parking area toy 100 through the slope 40, according to selection. The selection of the courses can be carried out by operating the course changing switch 74 to pull a guide member in or out.

Arrangement of Parking Spaces

The floor of each story of the body 10 expands in an approximate fan-shape around the lifting space for the turn table 50, as shown in FIG. 2. Each of the parking spaces extends radially, about the central axis of the turn table 50. To the parking spaces, reference numerals 1–7 are conveniently attached, respectively, to indicate the lateral positions thereof in the floor.

Floor Setting Member

The floor setting member for setting the floor to park the car toy has a construction, as follows.

Figure 3:
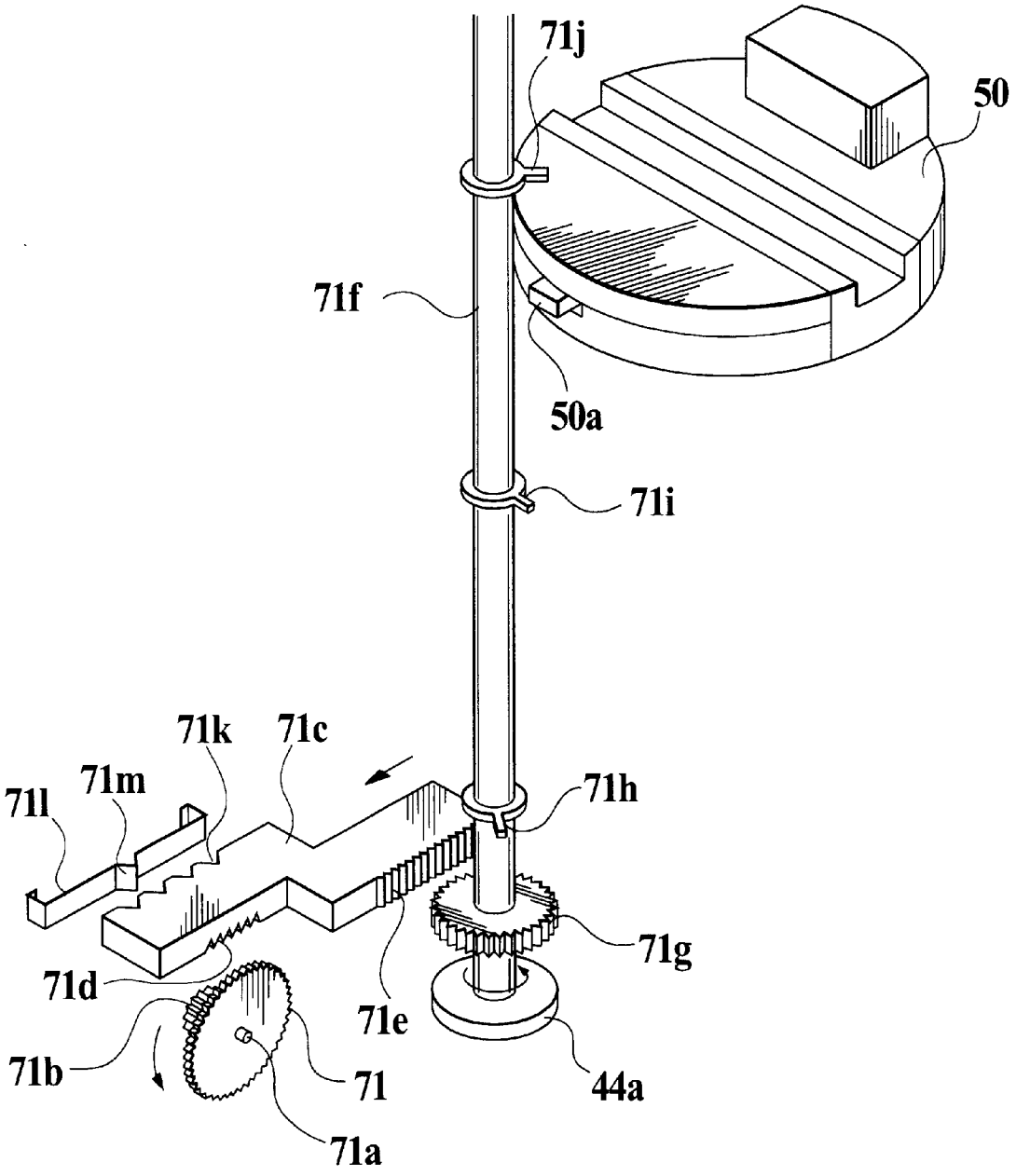
FIG. 3 is a perspective view for showing the floor setting member in the parking area toy shown in FIG. 1.

As shown in FIG. 3, to the rotary shaft 71*a* of the floor selection dial 71, a gear 71*b* is attached to engage with a first rack gear 71*d* which is formed on the lower surface of an end of a rack plate 71*c*. On a side surface of the other end of the rack plate 71*c*, a second rack gear 71*e* is formed to engage with a toothed gear 71*g* which is provided on a rotary shaft 71*f*. On the periphery of the rotary shaft 71*f*, engaging members 71*h*, 71*i* and 71*j* are attached at positions corresponding to each of the stories. The engaging members 71*h*, 71*i* and 71*j* are constructed to strike against a pawl 50*a* which is provided on the periphery of the turn table 50, according to the rotary position of the rotary shaft 71*f*. As a result, ascending of the turn table 50 is stopped by the striking of pawl 50*a* against the engaging member 71*h*, 71*i* or 71*j*. For example, in order to stop the turn table 50 at the second floor, it is required that the floor selection dial 71 is rotated up to the position of second floor. Then, the engaging members 71*i* is rotated through a predetermined angle by the rotation of the floor selection dial 71 through the first rack gear 71*d*, the second rack gear 71*e* and the toothed gear 71*g* on the shaft 71*f*, so that a projection of the engaging members 71*i* can be engaged with the pawl 50*a* of the turn table 50 by ascending of the turn table 50.

In a side surface of an end of the rack plate 71*c*, a positioning portion 71*k* with four notches is formed. Adjacent to the four notches, a plate spring 711 which is attached to the body 10 and has a bent portion 71*m* is disposed so that the bent portion 71*m* engages with one of the four notches to set the selected floor and to perform positioning for the rack plate 71*c*. The four notches are for positioning the rack plate 71*c* for the initial position, and positions of first, second and third floors, respectively. On a portion of the upper surface of the rack plate 71*c*, a color seal is attached to be seen by the operator through one of windows formed in the cover case to indicate the selected floor visually.

Lateral Position Setting Member

The lateral position setting member for setting the parking space in a floor to park the car toy has a construction, as follows.

Figure 4:
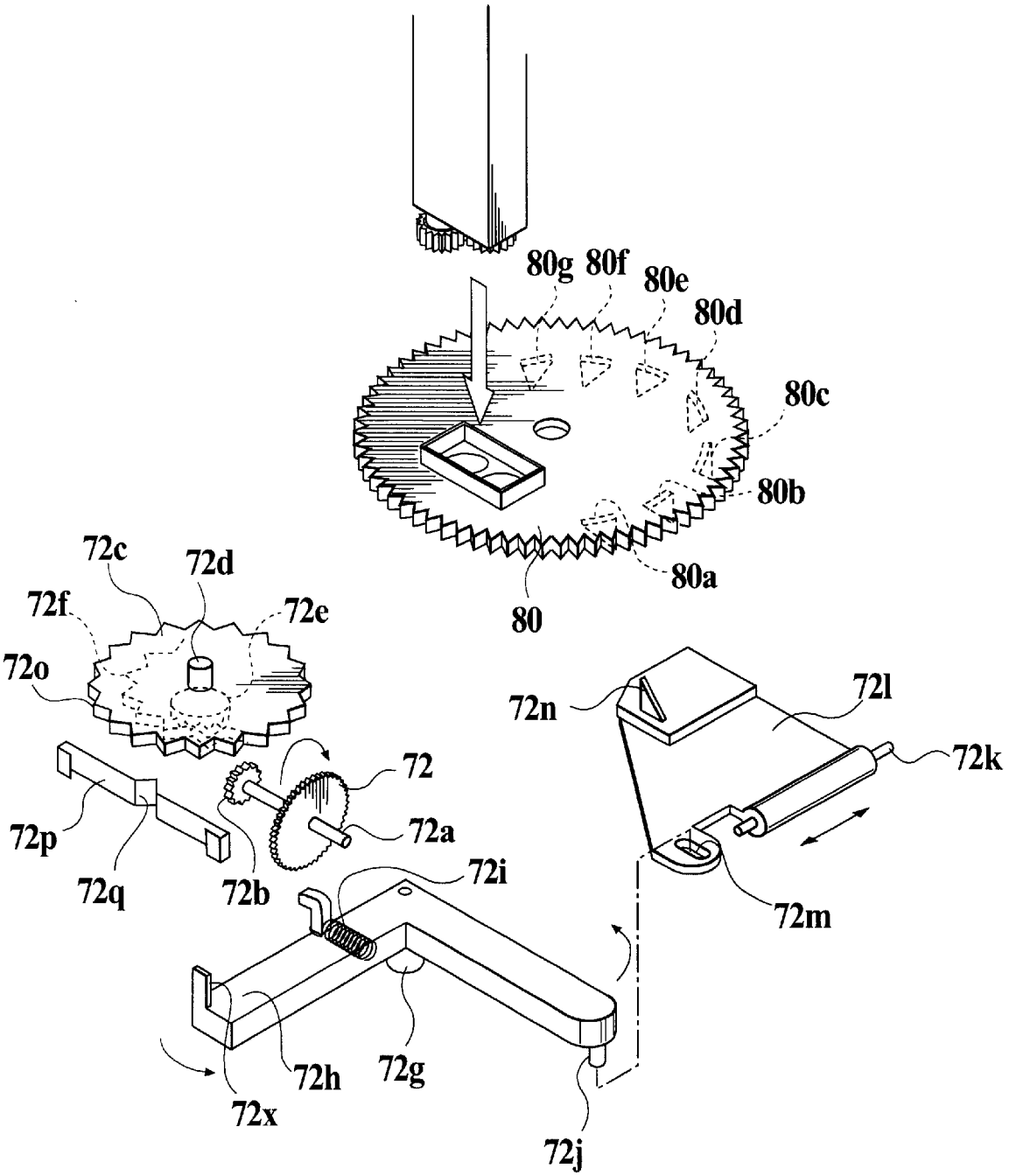
FIG. 4 is a view for showing the lateral position setting member in the parking area toy shown in FIG. 1.

As shown in FIG. 4, the lateral position selection dial 72 is provided with a gear 72*b* attached to the rotary shaft 72*a*. The gear 72*b* is engaged with a crown gear 72*e* which is attached to the rotary shaft 72*d* of the rotary plate 72*c*. The rotary plate 72*c* is provided with a cam 72*f* which is always brought into contact with a standing portion 72*x* formed at an end of a lever 72*h* by a pulled biasing force of a spring 72*i*. An end of the spring 72*i* is fixed to an projection of the lever 72*h* and the other end thereof is fixed to the body. The lever 72*h* is rotatable on a shaft 72*g* reciprocally. At the other end on the lower surface of the lever 72*h*, a pin 72*j* stands erect downward. The pin 72*j* passes through a long small hole 72*m* which is formed at an end of an engaging member 72*l*. The engaging member 72*l* is rotatable around a shaft 72*k* reciprocally and is also movable in the direction of the shaft 72*k*. On the upper surface of the engaging member 72*l*, a triangular-shaped projection 72*n* is attached. The triangular-shaped projection 72*n* engages with any one of seven triangular-shaped projections 80*a* to 80*g* which are attached to the rear surface of a gear (floor plate) 80, selectively, according to the position of the engaging member 72*l* in the direction of the shaft 72*k*. The seven triangular-shaped projections 80*a* to 80*g* are arranged corresponding to the seven parking spaces which are provided on the floor of each story, respectively. The distance between the triangular-shaped projections 80*a* to 80*g* and the center of the gear 80 come to be small gradually in this order. For example, in order to stop the turn table 50 to face to the no. 2 of the parking spaces in FIG. 2, on a floor, it is required that the lateral position selection dial 72 is rotated up to the no. 2 position. Then, the triangular-shaped projection 72*n* of the engaging member 72*l* comes to engage with the triangular-shaped projection 80*b* which is attached to the rear surface of a gear 80, according to the rotation of the turn table 50.

Figure 7:
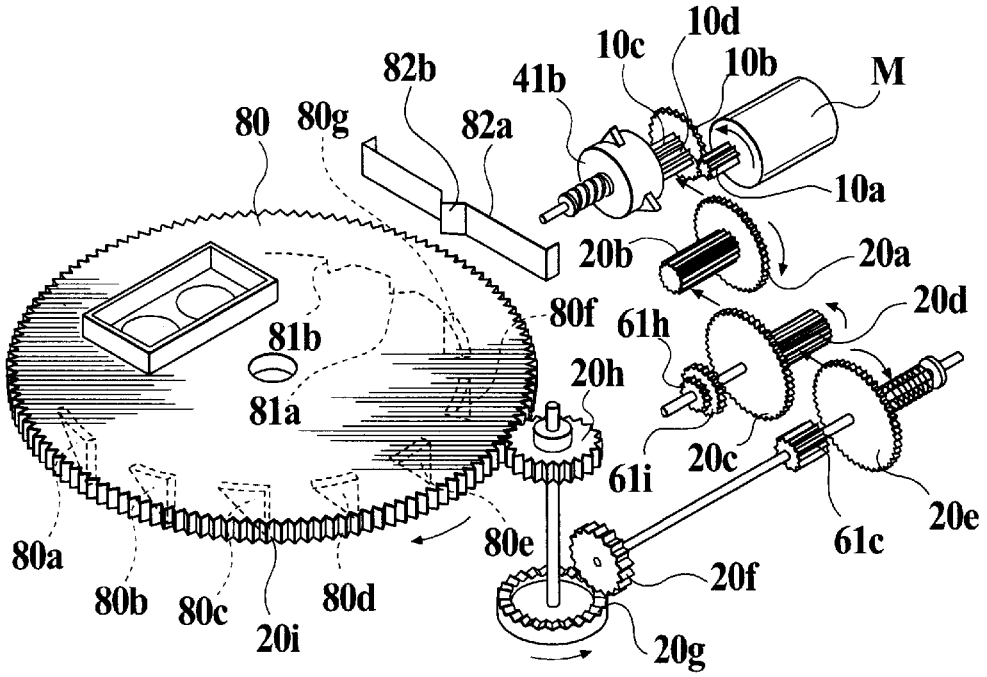
FIG. 7 is a schematic perspective explanation view showing the rotating mechanism for rotating the turn table in the parking area toy shown in FIG. 1.

In a periphery of the lower surface of the gear (floor plate) 80, eight notches 81*a* to 81*h* for positioning are formed, as shown in FIG. 7. Adjacent to the eight notches 81*a* to 81*h*, a plate spring 82*a* which is attached to the body 10 and has a bent portion 82*b*, is disposed so that the bent portion 82*b* engages with one of the eight notches to stop the turn table 50 at the position temporarily. The eight notches 81*a* to 81*h* are for positioning the turn table 50 for positions of first to eighth parking spaces in a floor and the initial position, respectively.

In a periphery of the rotary plate 72*c*, a positioning portion 72*o* with a plurality of notches for positioning is formed, as shown in FIG. 4. Adjacent to the notches, a plate spring 72*p* with a bent portion 72*q* is disposed so that the bent portion 72*q* engages with one of the notches to stop the rotary plate 72*c* and to set the lateral position. On a portion of the upper surface of the rotary plate 72*c*, a color seal is attached to be seen by the operator through one of windows formed in the cover case, to indicate the selected lateral parking space visually.

Turn Table Lifting Member

The turn table lifting member for lifting the turn table 50 up and down has a construction, as follows.

Figure 5:
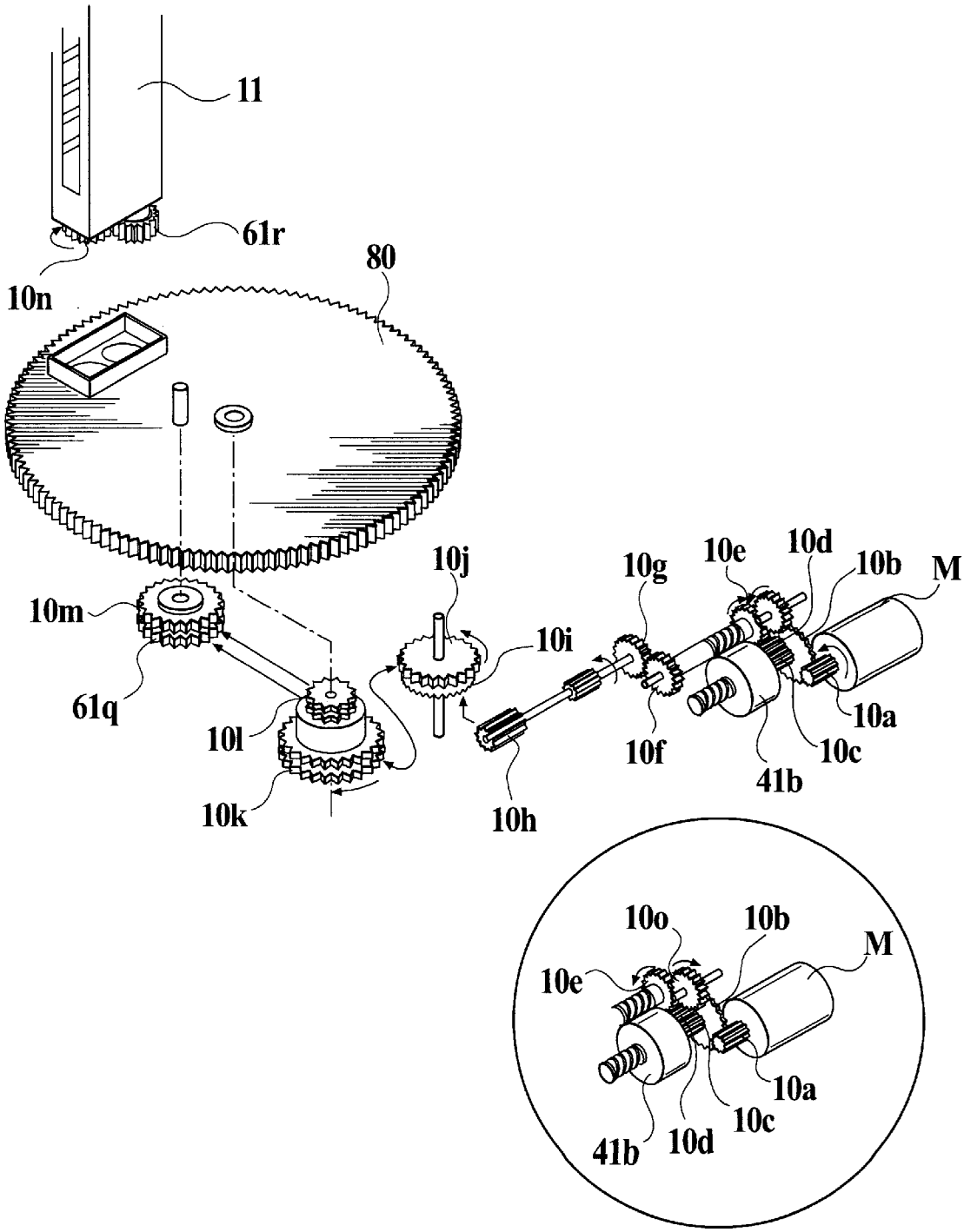
FIG. 5 is a view for showing the lifting member for ascending and descending the turn table in the parking area toy shown in FIG. 1.
Figure 6:
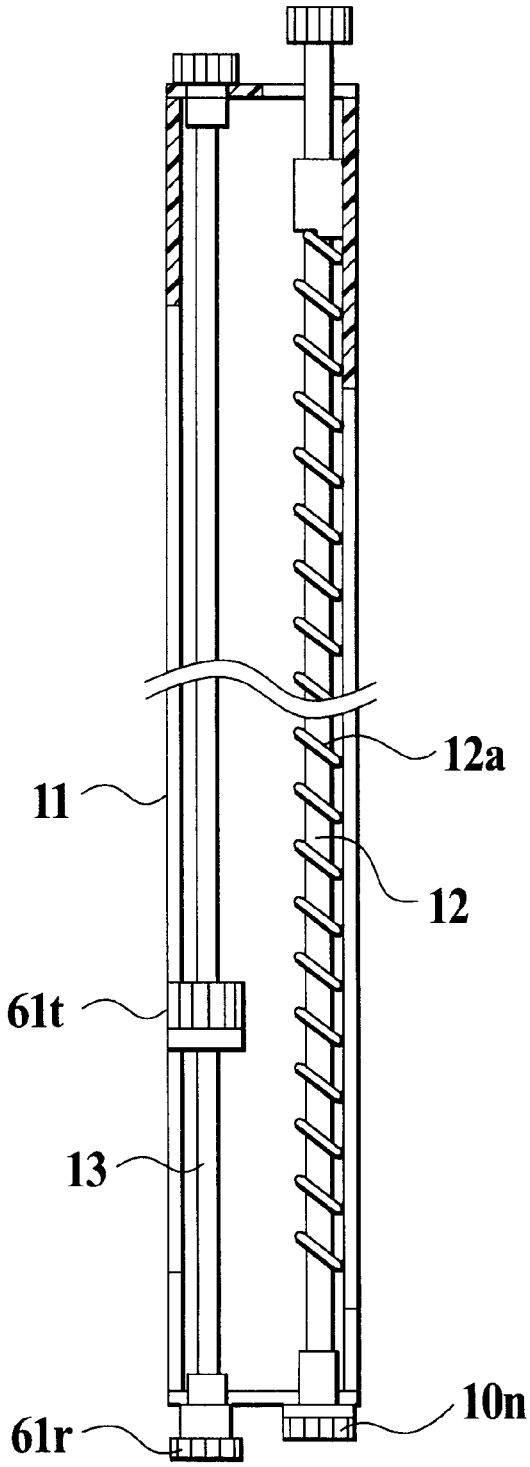
FIG. 6 is a view for showing the inner mechanism of supporting column in the parking area toy shown in FIG. 1.

As shown in FIG. 5, while the turn table 50 goes up, the rotary force of the motor M is transmitted to the gear 10*n* of the column 11 through the gears 10*a*, 10*b*, 10*c*, 10*d*, 10*e*, 10*f*, 10*g*, 10*h*, 10*i*, 10*j*, 10*k*, 10*l* and 10*m*. On the other hand, while the turn table 50 goes down, the rotary force of the motor M is transmitted to the gear 10*n* of the column 11 through the gears 10*a*, 10*b*, 10*c*, 10*d*, 10*o*, 10*e*, 10*f*, 10*g*, 10*h*, 10*i*, 10*j*, 10*k*, 10*l* and 10*m*, as shown in the circle of FIG.5. The gear 10*n* is attached to a shaft 12 having a spiral guide portion 12*a*, as shown in FIG. 6. Although the turn table 50 is not shown in this figure, it is engaged with the spiral guide portion 12*a*. As a result, when the shaft 12 is rotated by the motor M, the turn table 50 goes up or down according to the rotational direction of the shaft 12.

The gear 10*c* is a sun gear and the gear 10*d* is a planet gear. The latter planet gear 10*d* is provided on a drum 41*b* which is rotatable around the rotary axis of the sun gear 10*c*.

Turn Table Rotating Member

The turn table rotating member for rotating the turn table 50 has a construction, as follows.

As shown in FIG. 7, for rotating the turn table 50 in regular direction, the rotary force of the motor M is transmitted to the gear 20*i* of the gear wheel (floor plate) 80 through the gears 10*a*, 10*b*, 10*c*, 10*d*, 20*a*, 20*b*, 20*c*, 20*d*, 20*e*, 20*f*, 20*g* and 20*h*.

Member for Running Car Toy in and Out

The member for running a car toy in and out has a construction, as follows.

Figure 8:
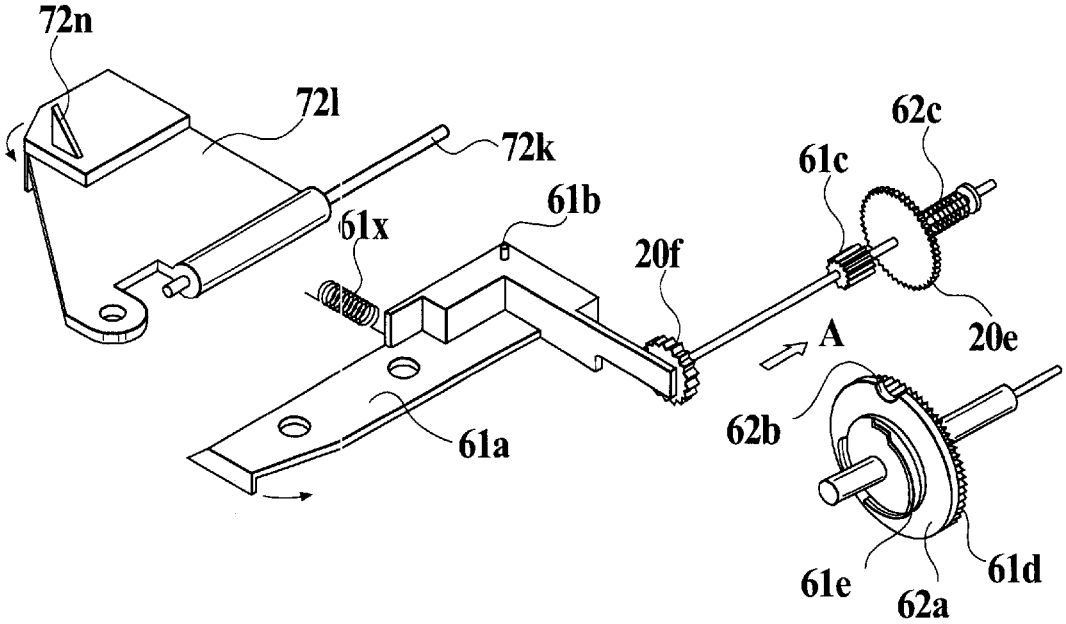
FIG. 8 is a schematic perspective explanation view showing the changing mechanism in the parking area toy shown in FIG. 1.

When the gear wheel (floor plate) 80 is rotated, that is, the turn table 50 is rotated to face to the predetermined direction, i.e., the direction of the desired parking space, the triangular-shaped projection 72*n* of the engaging member 72*l* comes to strike against one of the triangular-shaped projections 80*a* to 80*g* which is attached to the rear surface of the gear wheel (floor plate) 80, as shown in FIGS. 7 and 8. Accordingly, the engaging member 72*l* is rotated downwardly around the shaft 72*k* to rotate a swing plate 61*a* which is provided under the engaging member 72*l*, in the counterclockwise direction around the shaft 61*b*, as shown in FIG. 8. As the result, an end of the swing plate 61*a* presses the gear 20*f* in the direction shown by an arrow "A" to release the engagement of the gears 20*f* and 20*g*. Then, the triangular-shaped projection 72*n* gets over the hit one of the triangular-shaped projection 80*a* to 80*g*, and just thereafter the bent portion 82*b* of the plate spring 82*a* engages with the adjacent one of the notches for positioning 81*a* to 81*h* to stop the movement of the turn table 50 temporarily. In the state, the swing plate 61*a* and the engaging member 72*l* returns to the initial position by the pulled spring 61*x*. On the other hand, the gear 61*c* which is provided on the same rotary shaft as that of the gears 20*f* and 20*e* is moved in the direction of the arrow "A" together with the gears 20*f* and 20*e*. The gear 61*c* comes to engage with and rotate the gear 61*d* which is integral with the rotary plate 62*a*, by passing through the notch 62*b* of the rotary plate 62*a*, before the swing plate 61*a* and the engaging member 72*l* returns to the initial position. The depth of the notch 62*b* is made not to interrupt the rotation of the rotary plate 62*a*.

Figure 9:
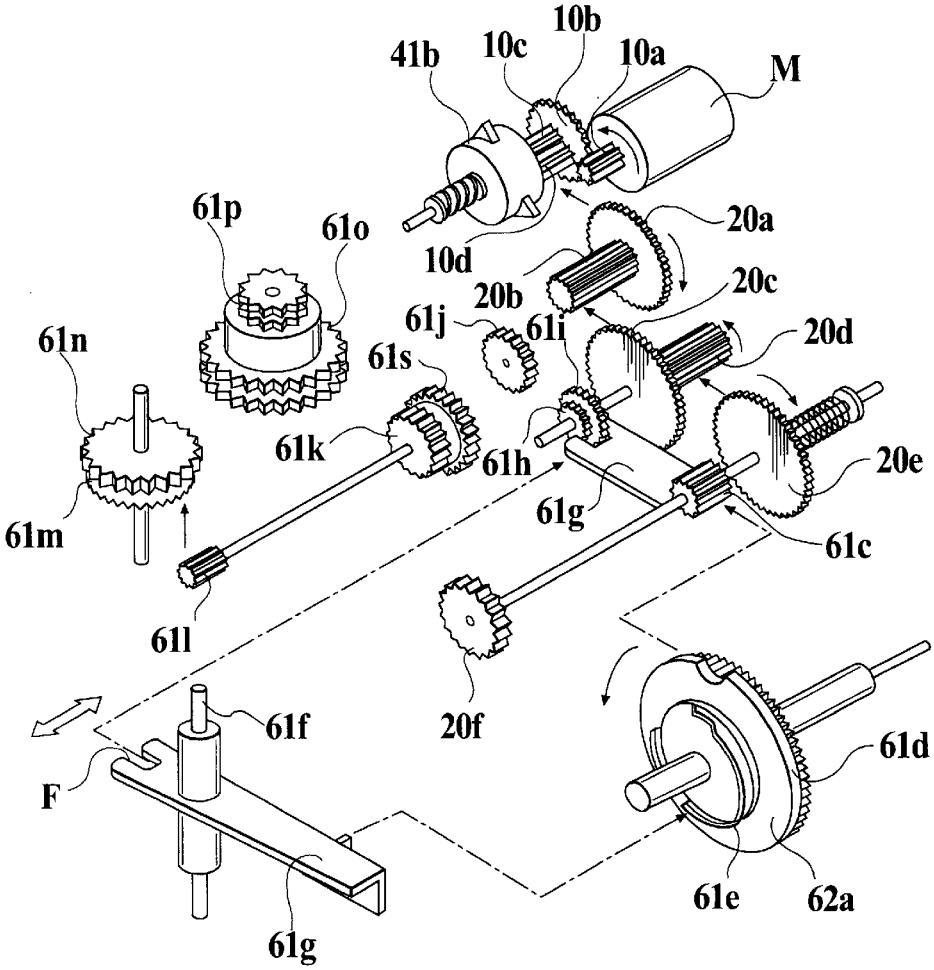
FIG. 9 is a schematic perspective explanation view showing the mechanism for running a car toy in and out of the parking area toy shown in FIG. 1.

On a surface of the rotary plate 62*a*, a cam 61*e* is formed. A swing member 61*g* which can swing around the shaft 61*f* is brought into contact with the cam 61*e*, as shown in FIG. 9. At an end of the swing member 61*g*, a forked portion "F" is formed to sandwich the gears 61*h* and 61*i* which are provided on the same rotary shaft as that of the gears 20*c* and 20*d*. When the gears 61*h* and 61*i* are moved by swinging of the swing member 61*g*, the gear 61*h* comes to engage with the gear 61*j*.

Figure 10:
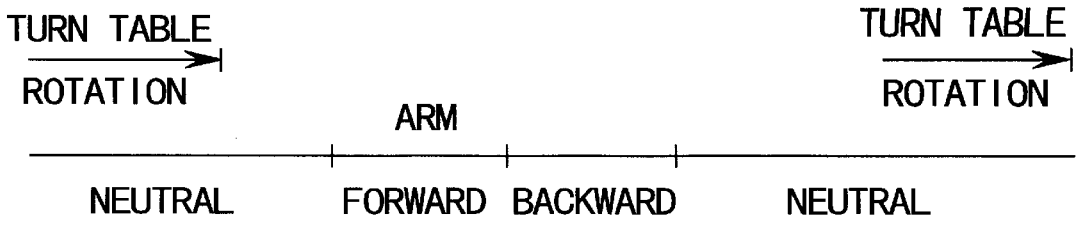
FIG. 10 is a view for showing the function of the cam of the parking area toy shown in FIG. 1.

The cam 61*e* functions as shown in FIG. 10. When the rotation of the turn table 50 in the regular direction is stopped, first, the cam becomes a neutral state, and then the state changes to one in that the rotary force of the motor M is transmitted to the gear 61*r* of the column 11, as shown in FIG. 5, through the gears 10*a*, 10*b*, 10*c*, 10*d*, 20*a*, 20*b*, 20*c*, 61*h*, 61*j*, 61*k*, 61*l*, 61*m*, 61*n*, 61*o*, 61*p* and 61*q*, that is, the arm projecting (forward) action. Next, the state changes to one in that the rotary force of the motor M is transmitted to the gear 61*r* of the column 11, through the gears 10*a*, 10*b*, 10*c*, 10*d*, 20*a*, 20*b*, 20*c*, 61*i*, 61*s*, 61*l*, 61*m*, 61*n*, 61*o*, 61*p* and 61*q*, that is, the arm drawing back (backward) action, and thereafter the state returns to the neutral state. These all states are carried out during a rotation of the rotary plate 62*a*. When the rotary plate 62*a* makes a round, the gear 61*c* reaches to the position of the notch 62*b* of the rotary plate 62*a*, and the gears 20*f*, 20*e* and 61*c* return to the initial position by the biasing force of the pushing spring 62*c*.

Figure 11:
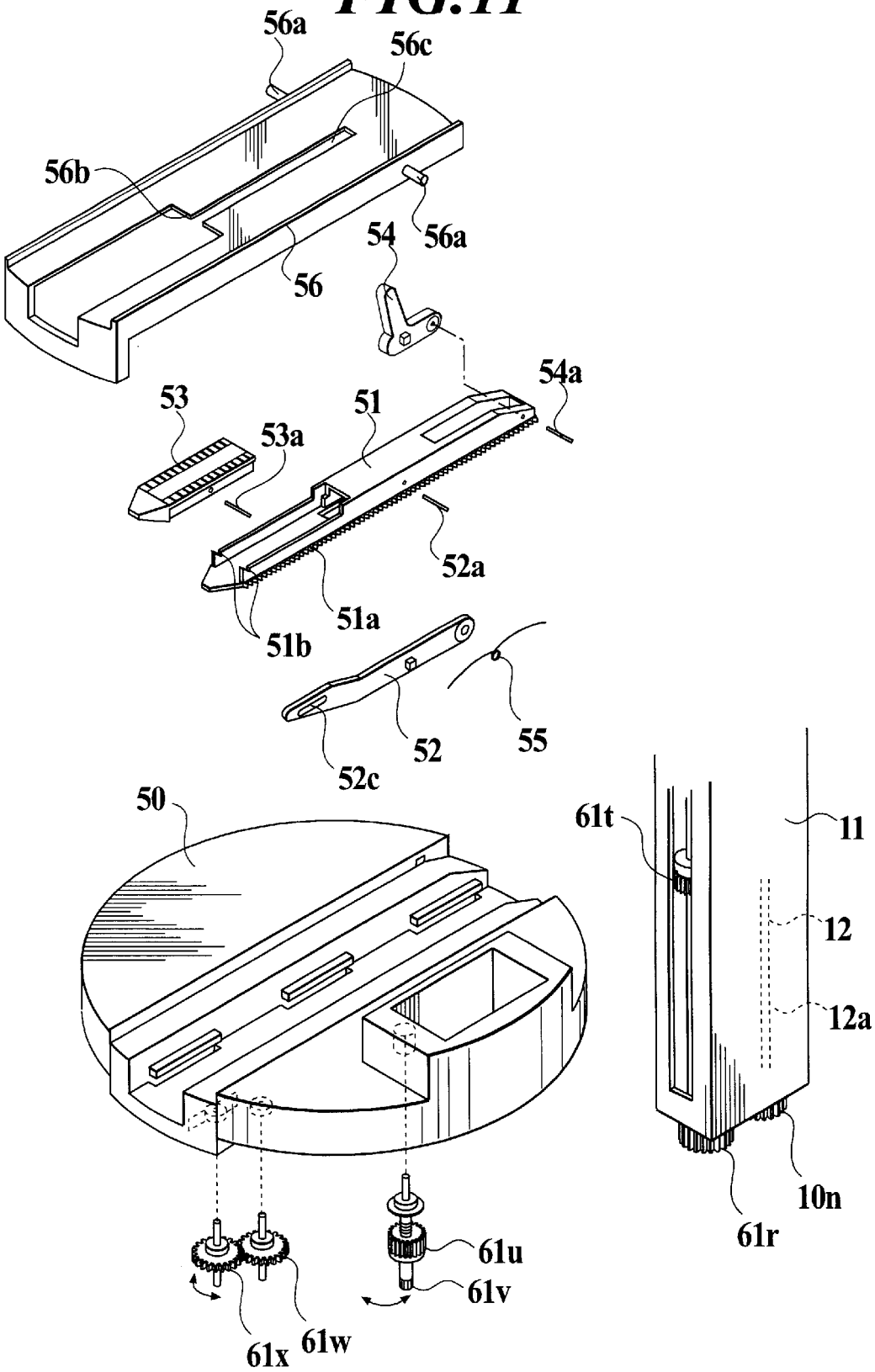
FIG. 11 is an exploded view of the turn table in the parking area toy shown in FIG. 1.

The gear 61*r* is attached to a rod 13 having a square-shaped section, as shown in FIG. 6. The rod 13 is provided also with a gear 61*t* which can go up and down together with the turn table 50. The rotary force of gear 61*t* is transmitted to the gear (rack gear) 51*a* of an arm member 51 through the gears 61*u*, 61*v*, 61*w* and 61*x* which are provided on the turn table 50, as shown in FIG. 11. The arm member 51 is movable in the direction of the diameter of the turn table 50. The top end of the arm member 51 can be come in and out of the periphery of the turn table 50 radially.

Figure 12A:
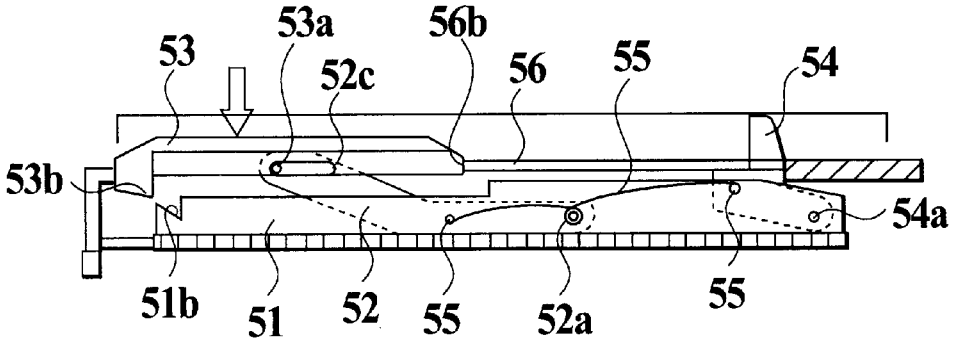
FIGS. 12A, 12B and 12C are views for showing an arm member, a member placed thereon and the like, in the parking area toy shown in FIG. 1.
Figure 12B:
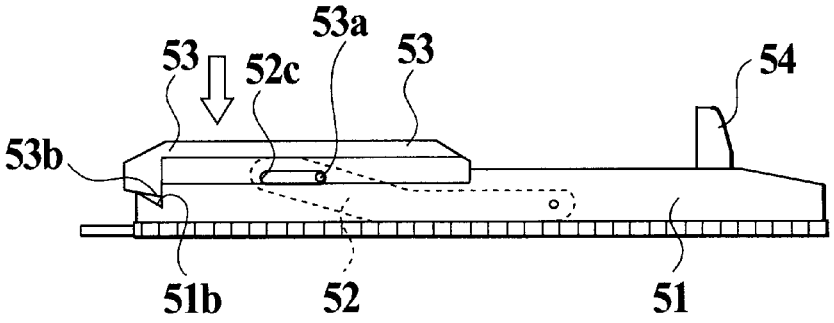
Figure 12C:
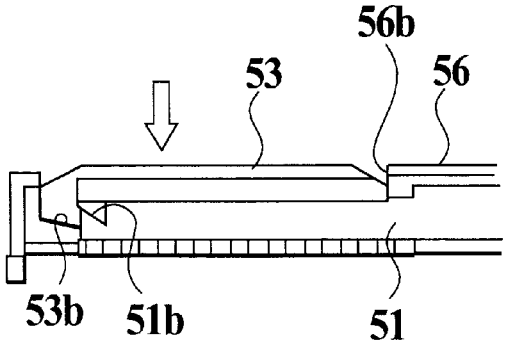

The arm member 51 is provided with a supporting member 52 therein which can swing around a shaft 52*a*, as shown in FIGS. 11, 12A, 12B and 12C. The top end of the supporting member 52 is positioned at a cutout portion 51*a* which is formed in the forward half of the arm member 51. In the top end of the supporting member 52, a small long hole 52*c* is formed to pass a pin 53*a* therethrough which is attached to the middle portion of a placing member 53 horizontally. The placing member 53 is supported by and placed on the top end of the supporting member 52 to be movable in the projecting direction of the arm member 51 within the length of the long hole 52*c*, as shown in FIGS. 12A to 12C. At the back end portion of the arm member 51, a pressing member 54 is attached to be swingable around the shaft 54*a*. Between the pressing member 54 and the supporting member 52, a torsion coil spring 55 is installed to give a biasing force in directions for the top end portion of the supporting member 52 and the top end of the pressing member 54 to project out of the arm member 51. The placing member 53 can take a first position at which it projects out of the top end of the arm member 51 in the radial direction of the turn table 50, as shown in FIG. 12A, and a second position at which it goes inside the top end of the arm member 51, as shown in FIG. 12B. At the first position, the placing member 53 is in a state to be able to go down, so as to change to the state shown in FIG. 12C. At the second position, a pawl 53*b* of the top end portion of the placing member 53 is placed on the arm member 51 to engage with the engagement portion 51*b* of the arm member 51. In this second state, a further descent of the placing member 53 is prevented in the course thereof. When the top end of the arm member 51 is within the turn table 50, the placing member 53 is held at the first position because the back end of the placing member 53 is pressed by the wall portion 56*b* of a discharging member 56 which will be explained later. On the other hand, when the top end of the arm member 51 is projecting from the turn table 50 radially, the placing member 53 can take the first and second positions.

Because of such a construction, it is possible to come a car toy in and out of the car parking area toy.

That is, when the turn table 50 is at the initial height position, i.e., the lowest position, because the top end of the arm member 51 is in the turn table 50, the placing member 53 is held at the first position. Therefore, when a car toy advances into the turn table 50, the car toy 20 strikes to the inclined surface portion of the top end of the placing member 53 and thereby the placing member 53 goes down to accept the car toy 20 thereon. On one hand, in the case of parking the car toy 20 into the parking space,the placing member 53 is at the first position. Therefore, when the arm member 51 projects, although the placing member 53 goes down, it is pushed out of the turn table 50 by the pressing member 54. As a result, the car toy 20 comes to be placed on the parking space. At the time, because the placing member 53 is at the first position, when the arm member 51 returns into the turn table 50, the car toy 20 comes to be left on the parking space. On the other hand, in the case of taking the car toy 20 out of the parking space, the arm member 51 gets into under the car toy 20. At the time, the pawl 53*b* of the placing member 53 comes to be placed on the engaging portions 51*b* of the arm member 51. Thereby, descent of the placing member 53 is prevented in the course thereof and thereby the car toy 20 is supported by the placing member 53. Because the arm member 51 returns into the turn table 50 in the state, the car toy 20 is taken out of the parking space. The placing member 53 strikes against the wall portion 56*b* of the discharging member 56 in the course of the arm member 51 returning into the turn table 50. Accordingly, the placing member 53 takes the first position.

The discharging member 56 has a structure to rotate around the shaft 56*a*. When the turn table 50 reaches the roof, the discharging member 56 strikes against a fixed portion of the body 10. Accordingly, the discharging member 56 rotates around the shaft 56*a* and is lifted, so that the car toy 20 is discharged from there. At this time, a projection which is provided on the lower side of the discharging member 56 but is not shown, pushes the pressing member 54. Thereby, the pressing member 54 is acted in the direction that the top end thereof goes down through the slit 56*c* of the discharging member 56. Thus, the car toy 20 is easily discharged.

Changing Member

Figure 13:
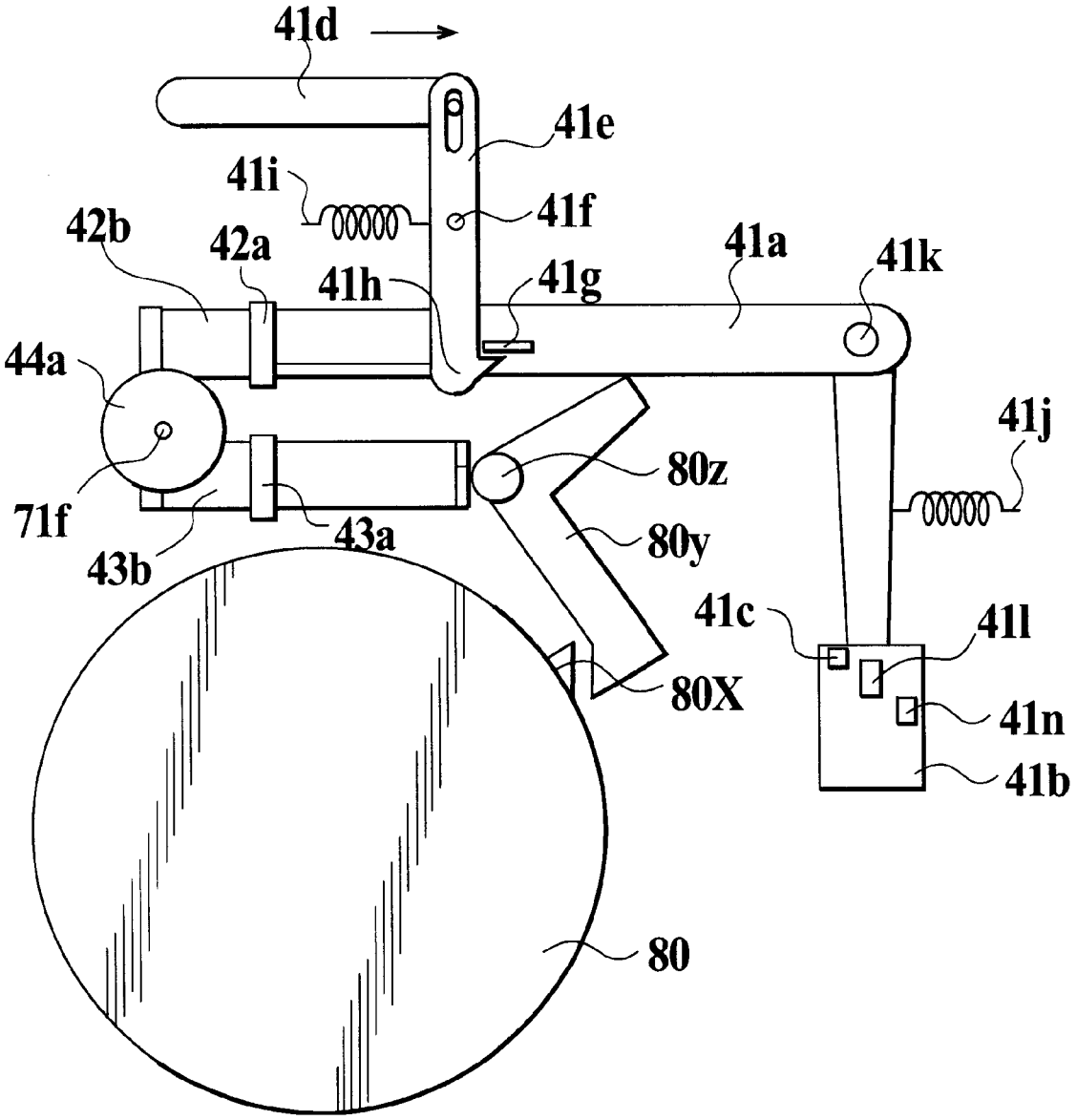
FIG. 13 is a construction view of the changing member for the parking area toy shown in FIG. 1.

When the turn table 50 is at the initial height position, i.e., the lowest position, the changing member is in the state (table drop state) shown in FIG. 13. In the state, the positioning member 41*a* engages with the first pawl 41*c* of a drum 41*b* (first position). The drum 41*b* supports the planet gear 10*d*. In the state that the drum 41*b* is not engaged with the positioning member 41*a*, the drum 41*b* rotates around the shaft of the sun gear 10*c* while the planet gear 10*d* rolls around the sun gear 10*c*.

In the state, when pushing the operational button 73, the slide member 41*d* is moved in the direction shown by the arrow. Thereby, an engagement lever 41*e* rotates around the shaft 41*f* against the biasing force of the pulled spring 41*i*. When the engagement lever 41*e* rotates around the shaft 41*f*, the engagement between the pawl 41*h* and the standing portion 41*g* of the positioning member 41*a* is disconnected. When the pawl 41*h* is disconnected from the standing portion 41*g*, the positioning member 41*a* rotates around the shaft 41*k* by the biasing force of the pulled spring 41*j*. Then, the positioning member 41*a* is transferred to the state of engaging with the second pawl 41*l* (second position). A concrete structure therefor will be explained as follows.

Figure 14:
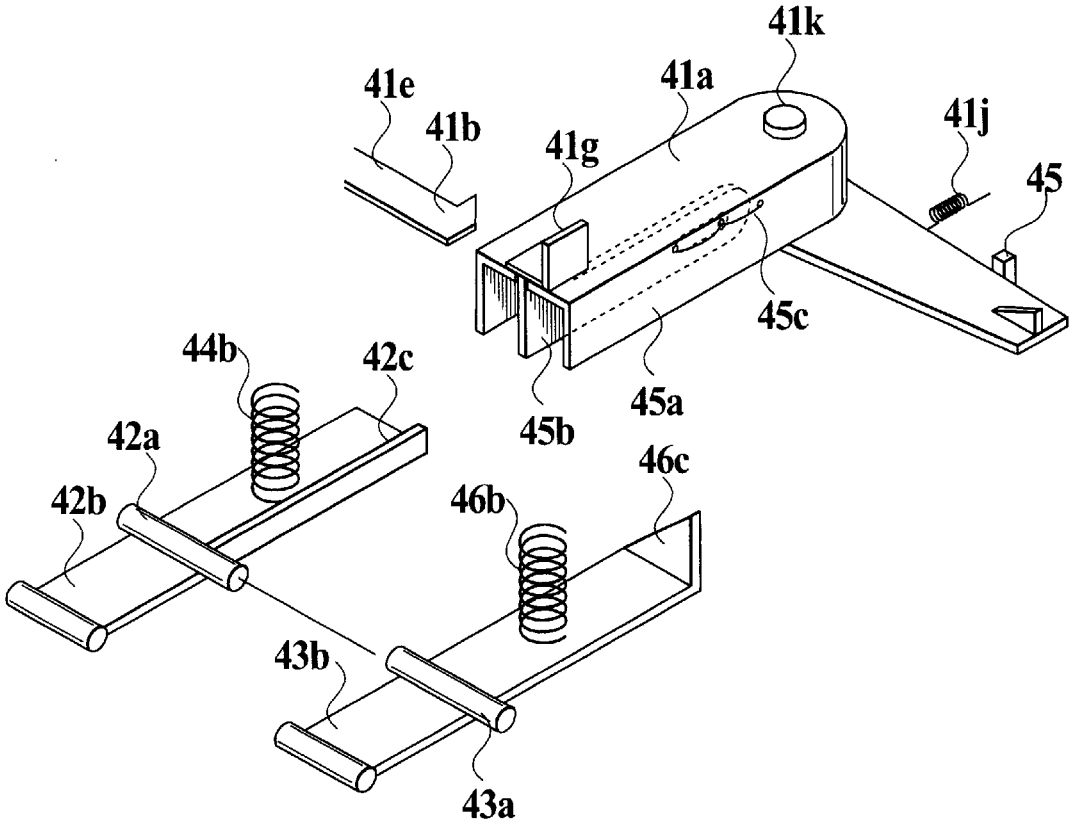
FIG. 14 is a construction perspective view of the changing member for the parking area toy.

In the vicinity of the positioning member 41*a*, a first seesaw member 42*b* which swings around the shaft 42*a* is provided, as shown in FIGS. 13 and 14. On a side of the first seesaw member 42*b*, a circular plate 44*a* which is provided at the lowest portion of the shaft 71*f* is placed, and on the other side thereof, pressed springs 44*b* are attached, as shown in FIG. 14. The first seesaw member 42*b* has a standing portion 42*c* which is formed at a side end on the other side. The standing portion 42*c* is positioned between a side wall 45*a* of the positioning member 4l*a* and a T-shaped engagement piece 45*b*. When the pawl 41*h* is off the standing portion 41*g*, the standing portion 42*c* comes to engage with the engagement piece 45*b*. The engagement piece 45*b* is biased downward by the torsion coil spring 45*c*. Adjacent to the first seesaw member 42*b*, a second seesaw member 43*b* which swings around the shaft 43*a* is provided. On a side of the second seesaw member 43*b*, a circular plate 44*a* which is provided at the lowest portion of the shaft 71*f* is placed, and on the other side thereof, pressed springs 46*b* are attached.

When the turn table 50 ascends to the predetermined floor, the pawl 50*a* of the turn table 50 hits to one of the engaging members 71*h*, 71*i* and 71*j* of the shaft 71*f*. Thereby, the shaft 71*f* is raised a little, to release the engagement between the standing portion 42*c* and the engagement piece 45*b*. Then, the positioning member 41*a* hits to a stopper 45 by the biasing force of the pulled spring 41*j* and the positioning member 41*a* is transmitted to the state to engage with a third pawl 41*n* (third position). This state is one which enables rotating the turn table 50.

After the turn table 50 supplied the car toy 20 to the desired parking space, when the gear 20*f* engages with the gear 20*g*, the turn table 50 rotates in the regular direction as far as the turn table 50 reaches the initial rotational position. When the turn table 50 reaches the initial rotational position, a pawl 80*x* of the gear wheel (floor plate) 80 is brought into contact with and pushes a changing lever 80*y*, so that the positioning member 41*a* is returned to the second position by the changing lever 80*y*. At the time, the bent portion 82*b* of the plate spring 82*a* engages with one of the notches 81*a* to 81*h*, so that rotation of the turn table 50 is prevented. Thereafter, when the turn table 50 goes up to the roof, the shaft 71*f* is forced to descend by a seesaw member which is not shown but operates by hitting of the turn table 50. As a result, the side with pushed spring 46*b* of the second seesaw member 43*b* is lifted, and the positioning member 41*a* is returned to the first position by an inclined portion 46*c* of the top end thereof, and thereby the pawl 41*h* is engaged with the standing portion 41*g*.

Although some embodiments of the invention have been explained as described above, it should also be understood that the present invention is not limited to the embodiments and that various changes and modifications may be made to the invention without departing from the gist thereof.

According to the parking area toy of the invention, it is possible to park a car toy into an optional parking space among a plurality of parking spaces which are disposed around the passage for moving the turn table up and down therethrough and to drive the car toy out of an optional parking space onto the turn table.

The entire disclosure of Japanese Patent Application Nos. Tokugan 2000-30987 and Tokugan 2000-30988, each filed on Feb. 8, 2000, including specification, claims, drawings and summary are incorporated herein by reference in its entirety.

What is claimed is:

1. A parking area toy comprising:

a body;

a turn table which can be rotated around a vertical axis and can be moved up and down along the vertical axis;

a plurality of parking spaces for parking a plurality of car toys, which are disposed on a plane around a passage for the turn table;

a turn table rotating member for rotating the turn table around the vertical axis;

a turn table lifting member for moving the turn table up and down along the vertical axis; and a member for driving a car toy in and out, which has a placing member for placing a car toy thereon and which is for moving a car toy into or out of a predetermined parking space by operating the placing member.

2. The parking area toy as claimed in claim 1, wherein the turn table lifting member comprises a first shaft extending along the vertical axis, which forms a screw pair together with the turn table and is rotationally driven by a motor, and the turn table is moved up and down along a column by rotating the first shaft reciprocally by the motor.

3. The parking area toy as claimed in claim 1, wherein the turn table rotating member has a gear wheel which is provided at a lower position and is rotationally driven around the vertical axis by a motor, and the turn table and the gear wheel are coupled with each other by a column so as to be rotatable as a body, and the turn table is rotationally driven by the motor through the gear wheel.

4. The parking area toy as claimed in claim 1, wherein the member for driving a car toy in and out comprises a second shaft extending along the vertical axis, which is rotationally driven by a motor, and the car toy is driven in or out by rotating the second shaft by the motor.

5. The parking area toy as claimed in claim 1, wherein the turn table rotating member, the turn table lifting member and the member for driving a car toy in and out can be driven by only one motor, and the turn table rotating member, the turn table lifting member and the member for driving a car toy in and out are driven selectively.

6. The parking area toy as claimed in claim 1, wherein the body has a plurality of stories each having a plurality of parking spaces.

7. The parking area toy as claimed in claim 6, further comprising a floor selection member for setting a floor to be parked and a lateral position selection member for setting a parking space to be parked in a floor, wherein the turn table rotating member, the turn table lifting member and the member for driving a car toy in and out goes the car toy in or out of a parking space set by the floor selection member and the lateral position selection member.

8. The parking area toy as claimed in claim 7, wherein the floor selection member comprises: a vertically erected rotatable shaft a rotational angle of which is varied according to the set floor, and a plurality of stoppers attached to a periphery of the erected rotatable shaft at an interval, each having a projection extending in a lateral direction different from one another, so that the erected rotatable shaft rotates and stops at a position that the projection of a corresponding stopper can engage with and stop the turn table.

9. A parking area toy comprising:

a body comprising a plurality of stories;

a turn table which can be rotated around a vertical axis and can be moved up and down along the vertical axis;

a plurality of parking spaces for parking a plurality of car toys, which are disposed on each of the stories, around a passage for the turn table;

a turn table rotating member for rotating the turn table around the vertical axis;

a turn table lifting member for moving the turn table up and down along the vertical axis; and a member for driving a car toy in and out, which has a placing member for placing a car toy thereon and which is for moving a car toy into or out of a predetermined parking space by operating the placing member;

wherein the turn table rotating member, the turn table lifting member and the member for driving a car toy in and out can be driven by only one motor.

10. The parking area toy as claimed in claim 9, wherein the turn table rotating member, the turn table lifting member and the member for driving a car toy in and out are driven selectively.

* * * * *